US006260447B1

(12) United States Patent
Hutt

(10) Patent No.: US 6,260,447 B1
(45) Date of Patent: Jul. 17, 2001

(54) RATCHET TOOL HOLDER

(76) Inventor: Heinz Hutt, 8 Apple Hill, Baie d'Urfée, Quebec (CA), H9X 3G6

( * ) Notice: Subject to any disclaimer, the term of this patent is extended or adjusted under 35 U.S.C. 154(b) by 0 days.

(21) Appl. No.: 09/337,535

(22) Filed: Jun. 22, 1999

(51) Int. Cl.[7] ..... B25B 13/46
(52) U.S. Cl. ..... 81/63; 81/61
(58) Field of Search ..... 81/63, 61, 62, 81/58.4, 63.1

(56) References Cited

U.S. PATENT DOCUMENTS

| | | | | |
|---|---|---|---|---|
| 270,516 | | 1/1883 | Turner . | |
| 798,892 | | 9/1905 | Evans . | |
| 828,026 | | 8/1906 | Garrigus et al. . | |
| 921,518 | | 5/1909 | Dixon . | |
| 929,036 | | 7/1909 | Smith . | |
| 2,060,609 | | 11/1936 | Clabby . | |
| 3,290,779 | | 12/1966 | Bridges et al. . | |
| 3,448,641 | | 6/1969 | Morrow . | |
| 3,635,654 | * | 1/1972 | McFarland | 81/63 |
| 3,715,168 | | 2/1973 | Kuhn . | |
| 4,111,077 | * | 9/1978 | Cummings et al. | 81/63 |
| 4,722,253 | * | 2/1988 | Chow | 81/63 |
| 4,770,072 | * | 9/1988 | Neuhaus | 81/63 |
| 6,070,502 | * | 1/2000 | Chang | 81/63 |

* cited by examiner

*Primary Examiner*—James G. Smith
*Assistant Examiner*—Hadi Shakeri
(74) *Attorney, Agent, or Firm*—François Martineau

(57) ABSTRACT

An elongated hollow handle forms a circular thru opening at one end. An annular ratchet gear is rotatably mounted within the handle and exposed in this opening and is adapted to carry a tool such as a die nut releasably secured within the gear and exposed thru opening. A double acting swivel pawl is centrally pivoted within the hollow handle and has two spaced pawl projections equally spaced from the pivot axis of the swivel pawl. A. transversely movable slider has opposite push buttons alternately protruding from the sides of the hollow handle; this slider has a spring bias plunger adapted to engage alternately opposite notches made in the rocker member on each side of its pivot axis. Therefore, a simple push on the protruding push button will change the direction in which the gear is rotated when swinging the handle back and forth. The gear has knurled exposed surfaces to enable manual grasping of the gear to brake its rotation during ratcheting.

13 Claims, 3 Drawing Sheets

2
4
6
8
10
12
14
16
18
20
21
22
24
26
28
30
32
34
36
37
38
40
42
44
46
48
50
52
54
56
58
60
62
64
66
68
70
72
74
76
78
80
82
84

RATCHET TOOL HOLDER

FIELD OF THE INVENTION

The present invention relates to a ratchet tool holder more particularly designed for holding die nuts or taps. The holder is of the type which can rotate the tool in any direction with ratcheting in the opposite direction.

BACKGROUND OF THE INVENTION

Tool holders of the double ratcheting type have been known for a long time. However, their system to reverse the ratcheting direction is very often complicated and difficult and awkward to use.

For instance, in U.S. Pat. No. 270,516 dated Jan. 9, 1883 to Turner and entitled "Ratchet Drill", to change ratcheting direction, the levers A on each side of the handle M must be operated to selectively actuate two different pawls P.

In U.S. Pat. No. 828,026 dated Aug. 7, 1906 to Garrigus and Golling and entitled "Tool Holder", the pawl member 7, 8 must be rotated about its longitudinal axis through 180° in order to change ratcheting direction.

In U.S. Pat. No. 929,036 dated Jul. 27, 1909 to Smith and entitled "Ratchet Die-Stock", there are two pawl members 20 located on opposite sides of the handle and which must be selectively moved and locked and unlocked from respective rings 22 on opposite sides of the handle.

In all these known prior arrangements, it is rather awkward to change ratcheting direction, a serious drawback when this direction must be changed frequently during use.

OBJECT OF THE INVENTION

The general object of the present invention is therefore to provide a ratchet tool holder of the character described in which the change in the ratcheting direction can be effected very quickly and simply.

Another object of the present invention is to provide a ratchet tool holder of the character described which is more particularly suited for holding a die nut, for cutting or renewing threads on bolts.

Another object of the present invention is to provide a ratchet tool holder of the character described which is more particularly suited for holding various taps for threading holes or repairing the existing threads on said holes.

The object of the present invention is to provide a holder of the double ratcheting type to enable the die nut to cut or renew threads on bolts that are hard to reach or are immovable and to then retrieve the die.

Another object of the present invention is a holder of the character described designed to accept all European dies with an outside diameter of 25 mm, and American dies with an outside diameter of one inch.

Another object of the invention is to provide a holder of the character described with an adapter to be able to use dies of still greater diameters.

Yet, another object of the invention is to provide a ratchet tool holder of the character described which is of simple construction and made of a minimum of molded parts.

SUMMARY OF THE INVENTION

The ratchet tool holder of the present invention comprises an elongated hollow handle forming a circular through opening at one end, an annular ratchet gear rotatably mounted within said handle in register with said through opening, a securing device carried by said gear to releasably secure a tool within said gear, a slider member transversely mounted for movement in said handle from a first to a second pawl rotating position and forming push buttons alternately protruding from said handle in said pawl rotating positions, a rocker member having a central pivot parallel to the rotation axis of said gear and a first and a second pawl projection, said pawl projections equally spaced from said central pivot on opposite sides thereof, said rocker member mounted within said handle intermediate said gear and said slider member for rotation about said central pivot between two limit positions in one of which said first pawl projection is in ratcheting engagement with said gear and said second pawl projection clears said gear while in the other limit position said first pawl projection clears said gear and said second pawl projection is in ratcheting engagement with said gear, and a first spring loaded plunger carried by said slider member and biased against said rocker member, said first plunger shifted from one side to the other of said central pivot to bias rotation of said pawl member to a selected one of said two limit positions by manually pushing on a selected push button.

Preferably each gear tooth has a pair of radial side faces and each pawl projection has a generally V shape defining a locking face and a ratcheting face, said pawl projections being mirror images of each other.

There is provided a biasing system to bias said slider member in said first or second pawl rotating position.

Preferably said biasing system includes a partition transverse to and secured to said handle within the same and located adjacent the side of said slider member facing away from said rocker member, said partition having two spaced recesses facing said slider member, and a second spring loaded plunger carried by said slider member and releasably biased into one of said two recesses.

Preferably, said slider member has a thru bore, said first and second plungers slidably guided in opposite end portions of said thru bore and further including a compression spring located within said thru bore between said two plungers and biasing both plungers in opposite directions.

Preferably, said handle is formed of two identical molded half sections, each of U-shaped cross section defining a main wall and a peripheral wall upstanding from said main wall, and further including fasteners removably securing said two half sections in inverted position with said peripheral walls abutting each other.

Preferably, said slider member has a T-shape defining a main leg and two cross legs, said cross legs forming said two push buttons, said thru bore extending longitudinally through said main leg, said slide member in slidable contact with and guided by said main walls, said cross legs slidably contacting and guided in registering notches formed in said peripheral walls.

Preferably, said annular gear carries radial set screws for releasably positioning and retaining a tool or a tool adapter within said annular gear, said handle having an access hole opening into said circular through opening of said handle, said gear capable of taking a rotated position wherein said screw registers with said access hole to be accessible to a screw rotating tool inserted through said access hole.

A ratchet tool holder preferably further includes an adapter removably fitted into said annular gear and locked therein by said set screws and said adapter having a collar with a greater internal diameter than the internal diameter of said gear.

Preferably, said collar has a serrated inner circular surface to fit hexagon and twelve sided tools and carries radial fasteners to removably secure such a tool within said collar.

Preferably, said annular gear has end faces which are exposed in said thru opening of said handle and are knurled to be manually grasped to prevent gear rotation during handle ratcheting movement.

BRIEF DESCRIPTION OF THE PREFERRED EMBODIMENT

Figures 1, 2:
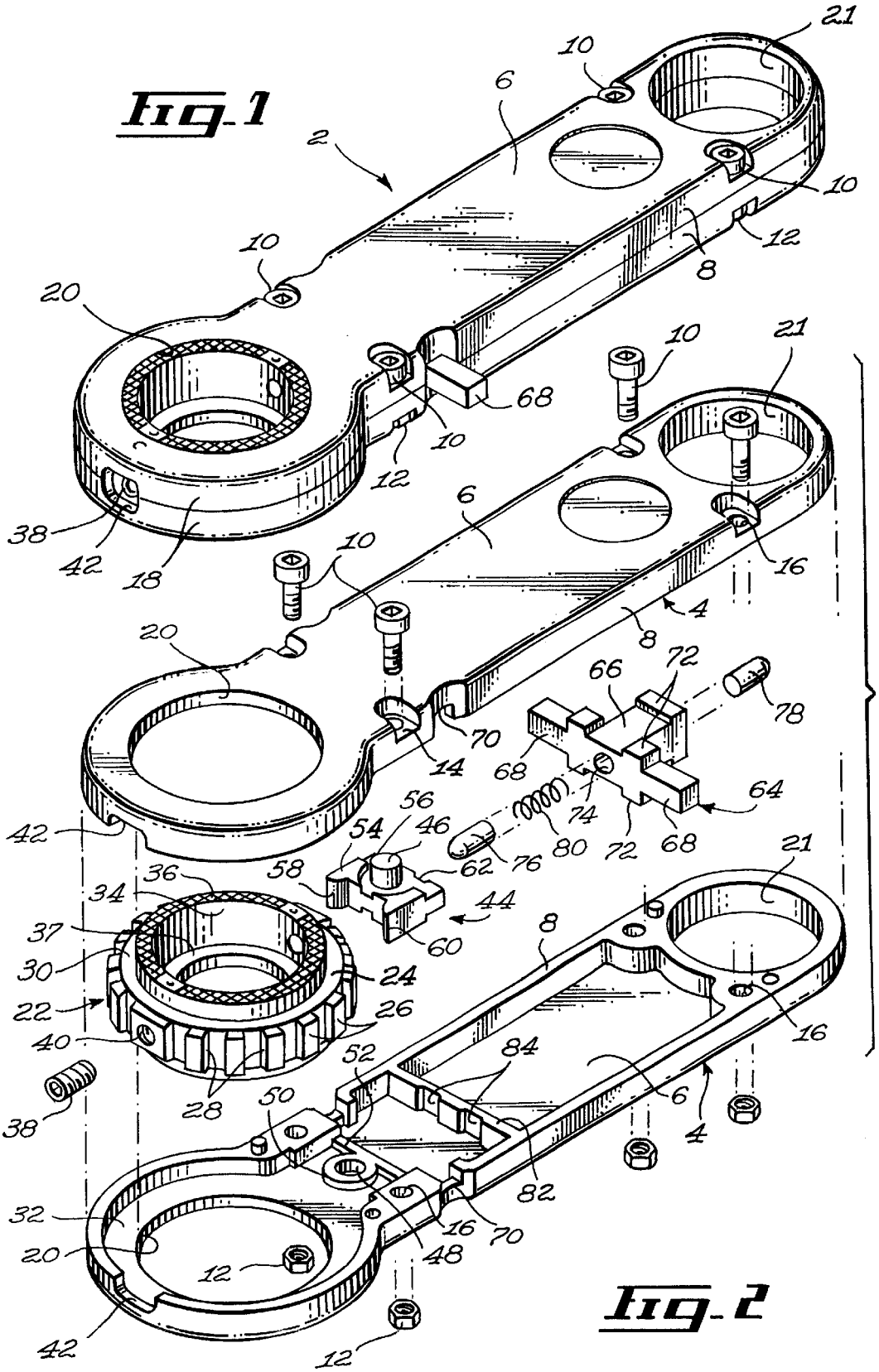
FIG. 1 is a perspective view of the ratchet tool holder of the invention.
FIG. 2 is an exploded perspective view of the component parts of the holder.
Figure 3:
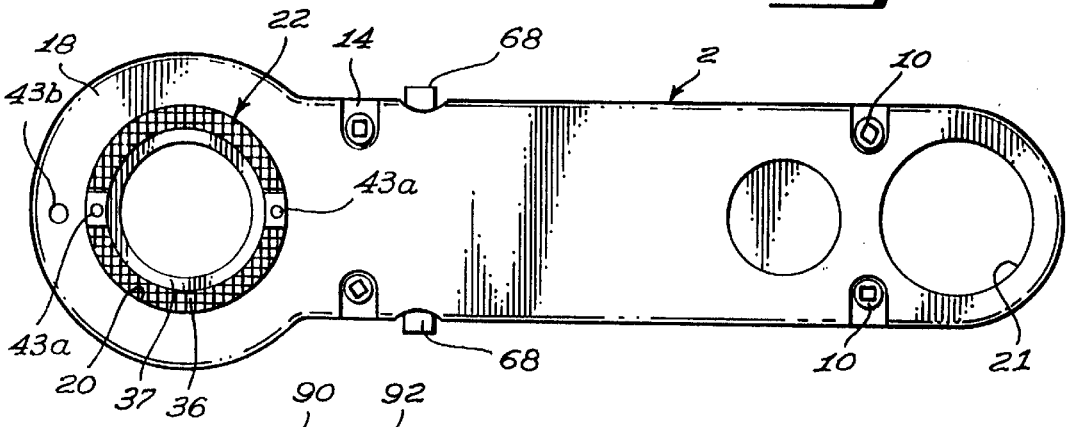
FIG. 3 is a top plan view of the holder.

The ratchet tool holder 2 of the present invention includes two molded half handle sections 4 of identical shape and each defining a main wall 6 and a peripheral wall 8. The two half sections 4 are secured together to form a hollow handle by means of bolts 10 and nuts 12. The bolts heads or nuts 12 engage cavities 14. The cavities 14 surround holes 16 for receiving the bolts 10.

Each half handle section 4 has an enlarged end 18 forming a thru opening 20; an opening 21 at the other end serves to hook the tool to a support when not in used.

An annular ratchet gear 22 is rotatably mounted within enlarged end 18 in register with thru opening 20. Ratchet gear 22 has a central rib 24 formed with a gear teeth 26 of symmetrical shape, each tooth having two opposites similar radial faces 28. The central rib 24 has opposite side faces 30 which rest on the main wall portion 32 which surrounds thru opening 20. Gear 22 has a cylindrical body 34 fitted in each thru opening 20 of the two half handle sections 4 for rotation therein. The cylindrical body 34 has knurled end faces 36 exposed in thru openings 20. Body 34 has an inwardly directed flange 37 at one end to form a seat for a die nut (not shown) fitted within body 34. As shown in FIG. 2, a set screw 38 is screwed within a threaded radial hole 40 made through the central rib 24 to releasably maintain die nut within the annular gear 22. There are two diametrically opposite set screws 38 to more firmly retain the die nut within the ratchet gear. Each set screw 38 is successively accessible through registering access notches 42 made in the peripheral wall 8 of the two half handle sections 4. Knurled end faces 36 have a marking 43*a* in register with each set screw 38 while each handle section 4 has a marking 43*b* in register with access notches 42. Rotating gear 22 to bring either marking 43*a* in alignment with marking 43*b* automatically presents a set screw 38 in access notches 42.

A flat rocker member 44 has oppositely protecting pivot studs 46 rotatably mounted within pivot holes 48 made in each half handle section 4. Each pivot hole 48 is formed by a circular rib 50; a transverse rib 52 is tangent to circular rib 50. Both ribs protrude from the main wall 6 of each handle section 4.

Rocker member 44 has two transversely spaced pawl projections 54 which are mirror images of each other. They are separated from each pivot stud 46 by a half circular groove 56. Each pawl projection 54 has a slanted inner side 58 and a straight outer side 60. The back of rocker member 44 forms spaced notches 62 equally spaced on each side of the pivot studs 46.

A T-shape slider member 64 is provided: it has a main leg 66 and two cross legs 68 which form push buttons. These cross legs alternately protrude from the sides of the handle sections 4 through registering side notches 70 made in the peripheral wall 8 of each handle section 4. Slider member 64 has raised portions 72 for slidably contacting the two main walls 6. A bore 74 extends through main leg 66 and houses a front plunger 76, a back plunger 78 and an intermediate compression spring 80. A transverse partition 82 with two forwardly facing notches 84 extend across each handle section 4.

Figure 8:
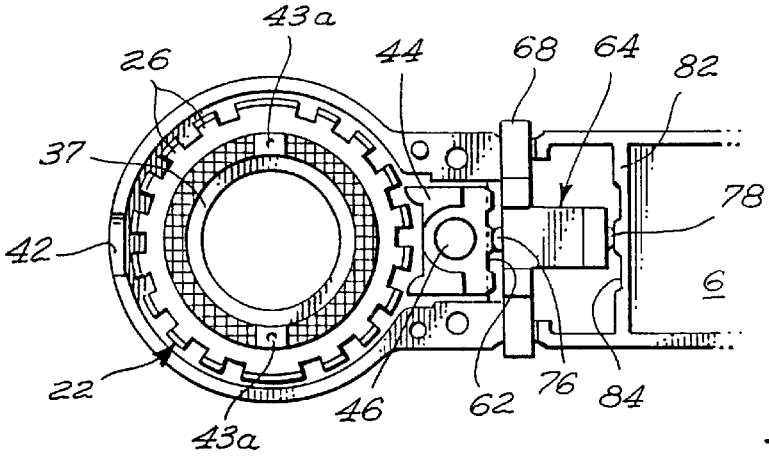
Figure 9:
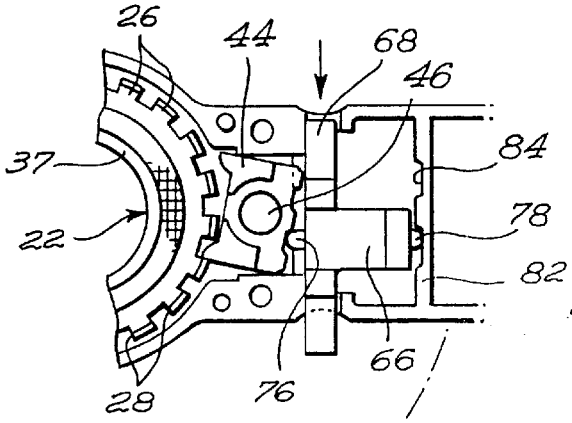
FIGS. 9 and 10 are views similar to that of FIG. 8 showing how the gear is ratcheted in two opposite directions.
Figure 10:
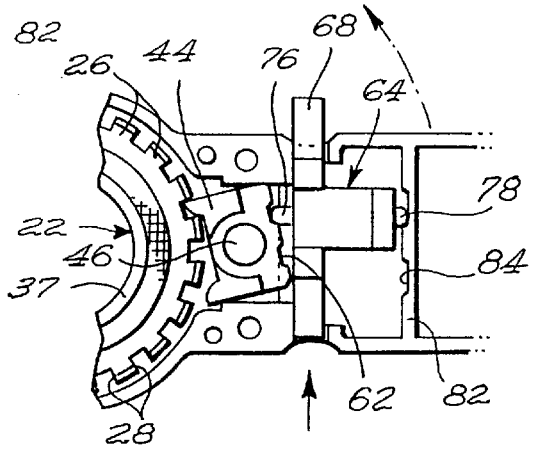

As shown in FIG. 8, when the slider member 64 is in intermediate central position with the two push buttons 68 equally protruding from the sides of the handle 2, the system is in neutral position, both pawl projections 54 clearing the gear teeth 26. Therefore, in this position, the gear can freely rotate in either one of its two opposite directions with respect to the handle. The push buttons 68 can be alternately pushed, using the thumb or index finger of the hand holding the handle 4 so as to swivel rocker member to either one of its two operating limit positions of FIGS. 9 and 10, wherein the straight outer side 60 of the pawl projection engages a gear tooth 26 of the ratchet gear 22. Ratcheting occurs when the slanted inner side 58 of the same pawl projection 54 slides on the edge of the gear teeth against the bias of front plunger 76. The slider member 64 is positively held in a selected ratcheting position against the bias of the back plunger 78 engaging one or the other plunger locating notches 84 of transverse partition 82.

Figure 4:
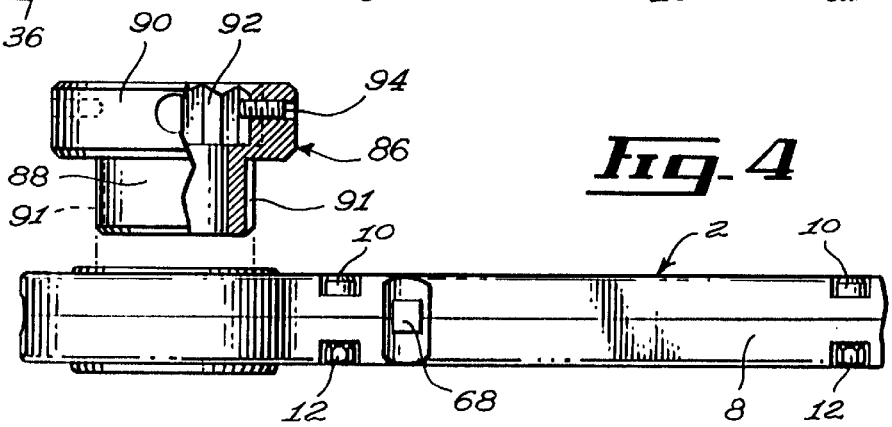
FIG. 4 is a side elevation of the same together with a tool adapter about to be fitted therein.
Figure 5:
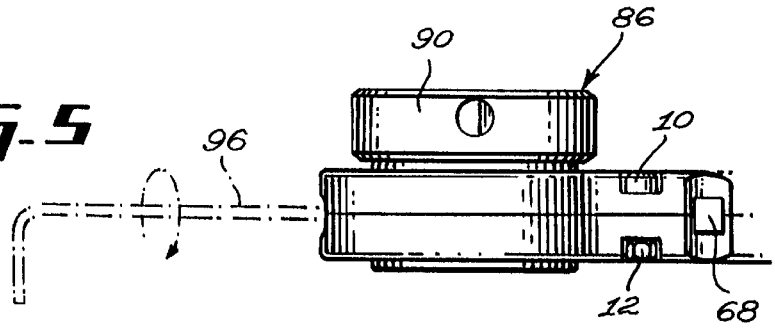
FIG. 5 is a partial side elevation of the holder with the adapter fitted therein.
Figure 6:
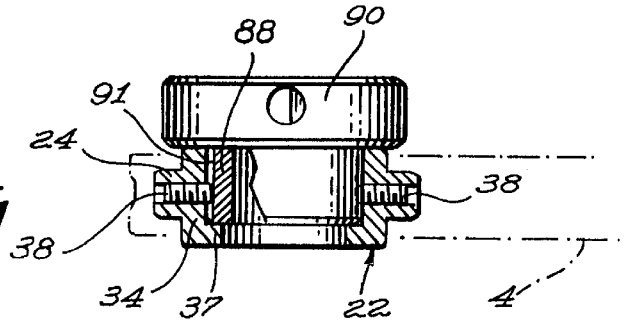
FIG. 6 is a partial cross section of the holder and adapter.
Figure 7:
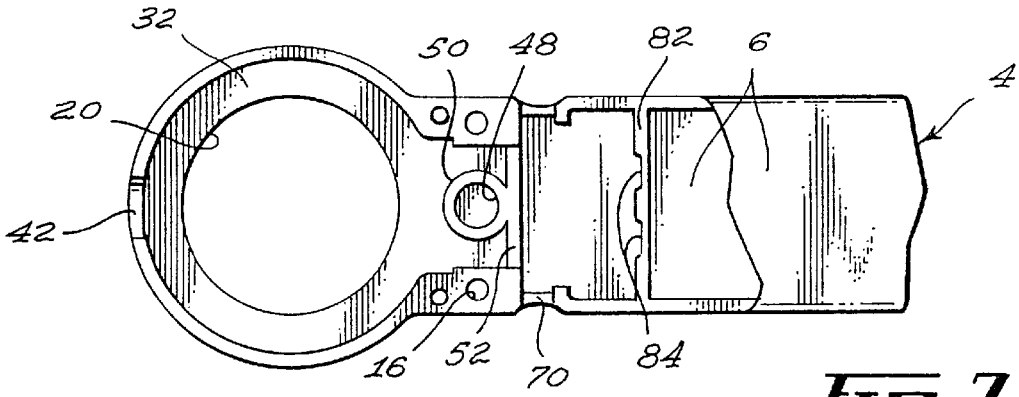
FIGS. 7 and 8 are partial plan views of the two half handle sections one with the ratchet gear and double pawl system mounted therein.

An adapter 86 can be used for holding a die nut of greater diameter than that which can be fitted within the annular ratchet gear 22. This adapter 86 as shown in FIGS. 4 to 6 includes an inner circular end portion 88 of smaller diameter and an opposite circular outer end portion 90 of larger diameter. End portion 84 has an outside diameter to fit within the annular ratchet gear 22, it is removably secured therein by the opposite set screws 38 engaging diametrically opposite keyways 91 at the outer surface of inner end portion 88. Larger diameter outer end portion 90 has an internal twelve sided surface 92 for receiving hexagonal or twelve sided die nuts. The die nuts are secured in position within the outer end portion 94 by means of two diametrically opposed set screws 90.

Set screws 38 or 94 are screwed or unscrewed by an Allen key 96 as shown in dotted lines in FIG. 5.

The tool can be used to ratchet a die nut in the direction required when repairing a bolt thread and in the opposite direction to remove the die nut after the work has been completed. Since during die nut removal, friction or resistance between the die nut and the bolt is less than during thread repairing, it might be necessary to effect a braking action on the circular ratchet gear 22 during the return swinging movement of the handle to allow ratcheting of rocker member 44.

This is why both opposite faces of the ratchet gear are knurled so that they can be simply pressed by the user's fingers during the return ratcheting movement.

What is claimed is:

1. A ratchet tool holder comprising an elongated hollow handle forming a circular through opening at one end, an annular ratchet gear having a rotation axis and rotatably mounted within said handle in register with said through opening, a securing device carried by said gear to releasably secure a tool within said gear, a slider member transversely mounted for movement in said handle from a first to a second position and forming push buttons alternately protruding from said handle in said first and second positions, a rocker member having a central pivot parallel to the rotation axis of said gear and a first and a second pawl projection, said pawl projections having one and another opposite sides and equally spaced from said central pivot on said opposite sides thereof, said rocker member mounted within said handle intermediate said gear and said slider member for rotation about said central pivot between two limit positions in one of which said first pawl projection is in ratcheting engagement with said gear and said second pawl projection clears said gear while in the other limit position, said first pawl projection clears said gear and said second pawl projection is in ratcheting engagement with said gear, and a front spring loaded plunger carried by said slider member and biased against said rocker member, said front plunger shifted from said one side to said other side of said central pivot to bias rotation of each said pawl projection to a selected one of said two limit positions by manually pushing on a selected push button.

2. A ratchet tool holder as defined in claim 1, wherein said gear has gear teeth, each tooth with a pair of radial side faces and each pawl projection has a generally V shape defining a locking face and a ratcheting face, said pawl projections being mirror images of each other.

3. A ratchet tool holder as defined in claim 2, further including a biasing system to bias said slider member in said first or second position.

4. A ratchet tool holder as defined in claim 3, wherein said biasing system includes a partition transverse to and secured to said handle within the same and located adjacent at end of said slider member facing away from said rocker member, said partition having two spaced recesses facing said slider member, and a back spring loaded plunger carried by said slider member and releasably biased into one of said two recesses.

5. A ratchet tool holder as defined in claim 4, wherein said slider member has a thru bore, said front and back plungers slidably guided in opposite end portions of said thru bore and further including a compression spring located within said thru bore between front and back plungers and biasing both said plungers in opposite directions.

6. A ratchet tool holder as defined in claim 5, wherein said handle is formed of two identical molded half sections, each of U-shaped cross section defining a main wall and a peripheral wall upstanding from said main wall, and further including fasteners removably securing said two half sections in inverted position with said peripheral walls abutting each other.

7. A ratchet tool holder as defined in claim 6, wherein said slider member has a T-shape defining a main leg and two cross legs, said cross legs forming said two push buttons, said thru bore extending longitudinally through said main leg, said slider member in slidable contact with and guided by said main walls, said cross legs slidably contacting and guided in registering notches formed in said peripheral walls.

8. A ratchet tool holder as defined in claim 7, wherein said annular gear carries radial set screws for releasably positioning and retaining a tool within said annular gear, said handle having an access hole opening into said circular through opening of said handle, said gear capable of taking a rotated position wherein one of said set screw registers with said access hole to be accessible to a screw rotating tool inserted through said access hole.

9. A ratchet tool holder as defined in claim 8, further including an adapter removably fitted into said annular gear and locked therein by said set screws said gear having an inner diameter and said adapter having a collar with a greater internal diameter than said internal diameter of said gear.

10. A ratchet tool holder as defined in claim 9, wherein said collar has a serrated inner circular surface to fit hexagon and twelve sided tools and carries radial fasteners to removably secure such a tool within said collar.

11. A ratchet tool holder as defined in claim 1, wherein said annular gear has end faces which are exposed in said thru opening of said handle and are knurled to be manually grasped to prevent gear rotation during handle ratcheting movement.

12. A ratchet tool holder as defined in claim 4, wherein said annular gear has end faces which are exposed in said thru opening of said handle and are knurled to be manually grasped to prevent gear rotation during handle ratcheting movement.

13. A ratchet tool holder as defined in claim 7, wherein said annular gear has end faces which are exposed in said thru opening of said handle and are knurled to be manually grasped to prevent gear rotation during handle ratcheting movement.

* * * * *